US010427418B2

(12) United States Patent
Yoshida

(10) Patent No.: US 10,427,418 B2
(45) Date of Patent: Oct. 1, 2019

(54) HEAD DRIVE DEVICE, THERMAL PRINTER, AND METHOD OF CONTROLLING A HEAD DRIVE DEVICE

(71) Applicant: Seiko Instruments Inc., Chiba-shi, Chiba (JP)

(72) Inventor: Daisuke Yoshida, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/899,794

(22) Filed: Feb. 20, 2018

(65) Prior Publication Data

US 2018/0244073 A1 Aug. 30, 2018

(30) Foreign Application Priority Data

Feb. 27, 2017 (JP) ..... 2017-034581

(51) Int. Cl.
*B41J 2/355* (2006.01)

(52) U.S. Cl.
CPC ..... *B41J 2/3551* (2013.01)

(58) Field of Classification Search
CPC ..... B41J 2/35; B41J 2/355; B41J 2/3551
See application file for complete search history.

(56) References Cited

U.S. PATENT DOCUMENTS 4,704,617 A * 11/1987 Sato ..... B41J 2/355 347/182
2009/0237483 A1* 9/2009 Nagumo ..... B41J 2/45 347/128
2014/0132696 A1* 5/2014 Moto ..... B41J 2/3351 347/211
2017/0157948 A1* 6/2017 Uno ..... B41J 2/355

FOREIGN PATENT DOCUMENTS

JP 2013-043379 A 3/2013

* cited by examiner

*Primary Examiner* — Kristal Feggins
(74) *Attorney, Agent, or Firm* — Brinks Gilson & Lione

(57) ABSTRACT

A head drive device includes a thermal head, a capacitor, a control circuit and a drive circuit. The thermal head has a first group of heat generators and a second group of heat generators having a smaller number of heat generators than the first group. The control circuit selects, based on printing data, whether to perform printing with use of the first group or to perform printing with use of the second group. The drive circuit supplies power of a power source and the power stored in the capacitor to the thermal head when the first group is used, and supplies the power of the power source to the thermal head when the second group is used. The control circuit performs printing with use the first or second group based on the storage state of the capacitor.

11 Claims, 13 Drawing Sheets

HEAD DRIVE DEVICE, THERMAL PRINTER, AND METHOD OF CONTROLLING A HEAD DRIVE DEVICE

RELATED APPLICATIONS

This application claims priority under 35 U.S.C. § 119 to Japanese Patent Application No. 2017-034581 filed on Feb. 27, 2017, the entire content of which is hereby incorporated by reference.

BACKGROUND OF THE INVENTION

1. Field of the Invention

The present invention relates to a head drive device, a thermal printer, and a method of controlling a head drive device.

2. Description of the Related Art

In recent years, thermal printers have been desired to have, concurrently with higher printing speed, a downsized and lower-capacity alternate current (AC) adapter as a power source in order to reduce the cost. Meanwhile, a head resistance value is reduced to increase the printing speed, and thus current consumption is increased. Under those circumstances, a technology of driving the thermal printer with use of a small-capacity power source is desired.

Hitherto, there are thermal printers configured to add power stored in a capacitor to the power of the power source to perform printing with use of a larger number of heat generators. In such thermal printers, the heat generators are required to be controlled in accordance with the amount of power stored in the capacitor.

SUMMARY OF THE INVENTION

According to one embodiment of the present invention, there is provided a head drive device, including: a thermal head, which is configured to cause one of a first group of heat generators and a second group of heat generators having a smaller number of heat generators than the first group of the heat generators, to generate heat; a capacitor configured to store power; a control circuit programmed, based on printing data, to select whether to perform printing with use of the first group of the heat generators or to perform printing with use of the second group of the heat generators; and a drive circuit programmed to: supply power of a power source and the power stored in the capacitor to the thermal head when the first group of the heat generators are used; and supply the power of the power source to the thermal head when the second group of the heat generators are used, the control circuit being programmed to: determine whether a predetermined amount of power is stored in the capacitor; allow printing with use of at least a part of the first group of the heat generators when the control circuit determines that the predetermined amount of power is stored in the capacitor; and allow printing with use of at least a part of the second group of the heat generators when the control circuit determines that the predetermined amount of power is not stored in the capacitor.

In the above-mentioned head drive device according to the one embodiment of the present invention, wherein the control circuit is programmed to: calculate a number of heat generators to be caused to generate heat based on the printing data; allow printing with use of at least a part of the second group of the heat generators when the calculated number of heat generators is equal to or smaller than a threshold value; and allow printing with use of at least a part of the first group of the heat generators when the calculated number of heat generators is larger than the threshold value and the control circuit determines that the predetermined amount of power is stored in the capacitor, and allow printing with use of at least a part of the second group of the heat generators when the control circuit determines that the predetermined amount of power is not stored in the capacitor.

In the above-mentioned head drive device according to the one embodiment of the present invention, wherein the thermal head is configured to cause one of the first group of the heat generators and the second group of the heat generators, to generate heat, the second group of the heat generators corresponding to at least one block obtained when the first group of the heat generators are divided into a plurality of blocks, and the control circuit is programmed to: calculate a number of heat generators to be caused to generate heat in one row of the thermal head; allow printing with use of at least a part of the first group of the heat generators when the calculated number of heat generators is equal to or smaller than an upper limit value of the number of heat generators that is able to be printed by the power of the power source; and allow printing with use of at least a part of the first group of the heat generators when the calculated number of heat generators is larger than the upper limit value of the number of heat generators that is able to be printed by the power of the power source and the control circuit determines that the predetermined amount of power is stored in the capacitor, and allow printing with use of at least a part of the second group of the heat generators when the control circuit determines that the predetermined amount of power is not stored in the capacitor.

In the above-mentioned head drive device according to the one embodiment of the present invention, wherein the control circuit is programmed to determine that the predetermined amount of power is stored in the capacitor when a printing medium is conveyed by an amount that is equal to or larger than a predetermined movement amount after the capacitor supplies power to the thermal head.

The above-mentioned head drive device according to the one embodiment of the present invention, further including a counting unit programmed to count a number of lines of printing, wherein the control circuit is programmed to determine that the predetermined amount of power is stored in the capacitor when the printing medium is conveyed by an amount that is equal to or larger than a predetermined number of lines after the capacitor supplies power to the thermal head.

The above-mentioned head drive device according to the one embodiment of the present invention, further including a time measurement unit programmed to measure time, wherein the control circuit is programmed to determine that the predetermined amount of power is stored in the capacitor when a predetermined storage time has elapsed after the capacitor supplies power to the thermal head.

According to one embodiment of the present invention, there is provided a thermal printer, including: a conveyance mechanism configured to convey a printing medium; and the above-mentioned head drive device, wherein the heat generators are arranged in one row that is orthogonal to a conveyance direction of the printing medium, and the drive circuit is programmed to control a speed at which the conveyance mechanism conveys the printing medium.

According to one embodiment of the present invention, there is provided a method of controlling a head drive device, the head drive device including: a thermal head, which is configured to cause one of a first group of heat generators and a second group of heat generators a smaller number of heat generators than the first group of the heat generators, to generate heat; and a capacitor configured to store power, the method including: selecting based on printing data whether to perform printing with use of the first group of the heat generators or to perform printing with use of the second group of the heat generators; supplying power of a power source and the power stored in the capacitor to the thermal head when the first group of the heat generators are used, and supplying the power of the power source to the thermal head when the second group of the heat generators are used; determining whether a predetermined amount of power is stored in the capacitor; allowing printing with use of at least a part of the first group of the heat generators when the predetermined amount of power is determined to be stored in the capacitor; and allowing printing with use of at least a part of the second group of the heat generators when the predetermined amount of power is not determined to be stored in the capacitor.

The above-mentioned method according to the one embodiment of the present invention, further including: calculating a number of heat generators to be caused to generate heat based on the printing data; allowing printing with use of at least a part of the second group of the heat generators when the calculated number of heat generators is equal to or smaller than a threshold value; and allowing printing with use of at least a part of the first group of the heat generators when the calculated number of heat generators is larger than the threshold value and the predetermined amount of power is determined to be stored in the capacitor, and allowing printing with use of at least a part of the second group of the heat generators when the predetermined amount of power is not determined to be stored in the capacitor.

In the above-mentioned method according to the one embodiment of the present invention, wherein the thermal head is configured to cause one of the first group of the heat generators and the second group of the heat generators, to generate heat, the second group of the heat generators corresponding to at least one block obtained when the first group of the heat generators are divided into a plurality of blocks, and the method further including: calculating a number of heat generators to be caused to generate heat in one row of the thermal head; allowing printing with use of at least a part of the first group of the heat generators when the calculated number of heat generators is equal to or smaller than an upper limit value of the number of heat generators that is able to be printed by the power of the power source; and allowing printing with use of at least a part of the first group of the heat generators when the calculated number of heat generators is larger than the upper limit value of the number of heat generators that is able to be printed by the power of the power source and the predetermined amount of power is determined to be stored in the capacitor, and allowing printing with use of at least a part of the second group of the heat generators when the predetermined amount of power is not determined to be stored in the capacitor.

The above-mentioned method according to the one embodiment of the present invention, the method further including: determining that the predetermined amount of power is stored in the capacitor when a printing medium is conveyed by an amount that is equal to or larger than a predetermined movement amount after the capacitor supplies power to the thermal head.

The above-mentioned method according to the one embodiment of the present invention, the head drive device further including: a counting unit programmed to count a number of lines of printing, the method further including: determining that the predetermined amount of power is stored in the capacitor when the printing medium is conveyed by an amount that is equal to or larger than a predetermined number of lines after the capacitor supplies power to the thermal head.

The above-mentioned method according to the one embodiment of the present invention, the method further including: determining that the predetermined amount of power is stored in the capacitor when a predetermined storage time has elapsed after the capacitor supplies power to the thermal head.

DETAILED DESCRIPTION OF THE EMBODIMENTS

Figure 1:
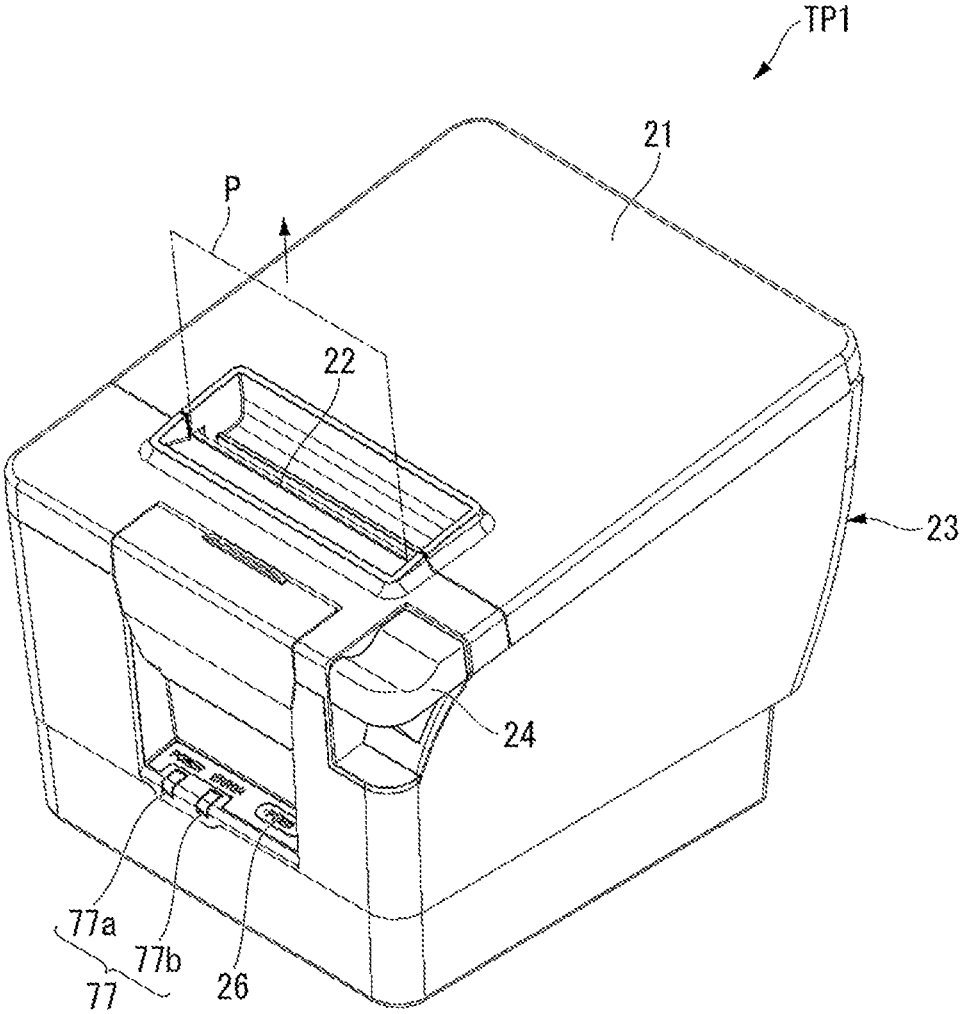
FIG. 1 is a perspective view for illustrating an example of a printer according to a first embodiment of the present invention.

Now, embodiments of the present invention are described in detail with reference to the drawings. FIG. 1 is a perspective view for illustrating an example of a printer TP1 according to a first embodiment of the present invention. In FIG. 1, the printer TP1 is, for example, a receipt printer. The printer TP1 is a thermal printer, and performs thermal printing onto a paper medium. In the first embodiment, description is given of a heat-sensitive-type printer configured to perform printing onto heat-sensitive paper, but the present invention is not limited thereto, and a heat transfer printer that uses an ink ribbon may be employed.

The printer TP1 includes a printer cover 21, a discharge port 22, a main body case 23, an operation portion 24, a state indication portion 77, and an actuation button 26. The state indication portion 77 includes a power indication lamp 77*a* and an error indication lamp 77*b*. The printer TP1 further includes a printer control unit (not shown).

As illustrated in FIG. 1, the printer TP1 performs printing onto heat-sensitive paper P pulled out from rolled paper (not shown). The heat-sensitive paper P subjected to printing can be used as, for example, a receipt or a ticket. The printer TP1 includes a conveyance mechanism (for example, a gear and a platen roller) (not shown). The conveyance mechanism conveys the heat-sensitive paper P. The printer TP1 includes a head drive device (not shown). The head drive device includes a drive circuit. The drive circuit controls a speed at which the conveyance mechanism conveys the heat-sensitive paper P. The printer TP1 is accommodated in the main body case 23 as described above.

Figure 2:
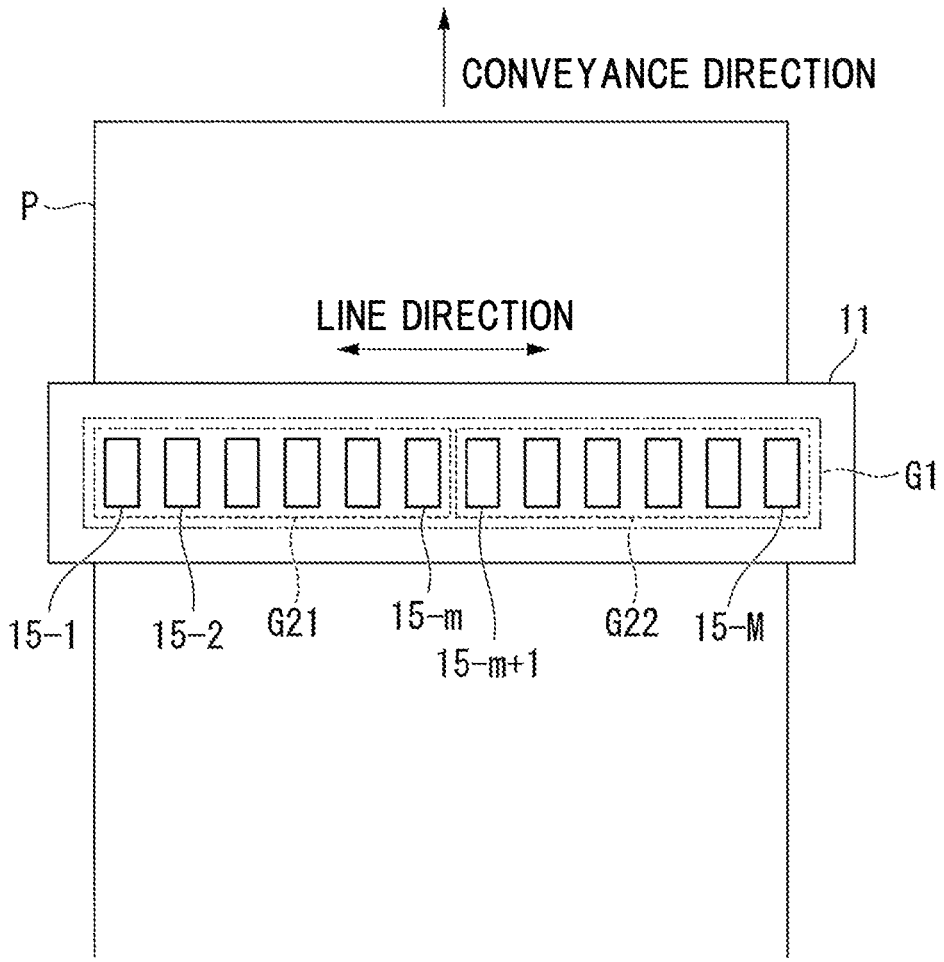
FIG. 2 is a plan view for illustrating an example of a thermal head in the first embodiment.

FIG. 2 is a plan view for illustrating an example of a thermal head 11 in the first embodiment. FIG. 2 is an illustration of the thermal head 11 of the printer TP1. The thermal head 11 includes heat generating elements 15. The heat generating elements 15 are formed of M heat generating elements 15-*m* (m=1, 2, . . . , M, where M is a natural number). In this case, M is, for example, 576. One heat generating element 15-1 is used when one dot is printed. In the thermal head 11, the heat generators are arranged in one row in a line direction. The heat-sensitive paper P is conveyed in a conveyance direction (sub-scanning direction) that is orthogonal to the line direction (main scanning direction).

The printer TP1 performs printing of at least one row (line) each time by causing the heat generating element 15-1 to the heat generating element 15-N to generate heat through energization. After each time of printing, the printer TP1 conveys the heat-sensitive paper P in the conveyance direction by an amount corresponding to the number of lines to be printed each time (by an amount corresponding the above-mentioned at least one line). When printing data continues after the conveyance, the printer TP1 performs the next printing. The printer TP1 repeats the printing of the at least one line (also referred to as "dot line") as described above to perform printing onto the heat-sensitive paper P. In the first embodiment, description is given of a case in which one line is printed in each time of printing. However, the present invention is not limited thereto, and two or more lines may be printed in each time of printing.

Divisional printing is described with reference to FIG. 2. The printer TP1 performs divisional printing. Divisional printing refers to printing performed by diving the heat generating elements 15-1 to 15-M (called "first group G1") of the thermal head 11 into several groups (also referred to as "blocks") and simultaneously causing only the heat generating elements 15-*m* belonging to a part of the groups to generate heat. For example, when M is 576, the heat generating elements 15-1 to 15-288 are grouped as a second group G21, and the heat generating elements 15-289 to 15-576 are grouped as a second group G22. The heat generating elements 15-1 to 15-288 in the second group G21 and the heat generating elements 15-289 to 15-576 in the second group G22 correspond to at least one block obtained when the heat generating elements 15-1 to 15-576 in the first group G1 are divided into a plurality of blocks. In this case, the printer TP1 first simultaneously causes at least one of the heat generating elements 15-*m* (where m=1 to 288) to be used in printing among the heat generating elements 15-1 to 15-288 to generate heat, to thereby perform printing. After that, in the next printing, the printer TP1 simultaneously causes at least one of the heat generating elements 15-*m* (where m=289 to 576) to be used in printing among the heat generating elements 15-289 to 15-576 to generate heat, to thereby perform printing.

The reason why the divisional printing is performed is as follows. That is, in the printer TP1, the number of heat generating elements 15-*m* that can be simultaneously energized is limited in accordance with the capacity of the power source. For example, the number of heat generating elements 15-*m* that can be simultaneously energized in each time of printing (printing of at least one dot line) (also referred to as "number of simultaneously energizable dots") is limited. For that reason, when the number of heat generating elements 15-*m* that generate heat in each time of printing, that is, the number of dots to be printed (also referred to as "number of printing dots") exceeds the number of simultaneously energizable dots, the printer TP1 performs the above-mentioned divisional printing. That is, the printer TP1 performs printing by using heat generating elements 15-*m* that are equal to or smaller in number than the number of simultaneously energizable dots a plurality of times.

For example, when a 24-volt power source having a peak current capacity of 10 A is used for a head having an 800-ohm/576-dot configuration, the number of simultaneously energizable dots is about 330 dots. Meanwhile, when an object to be subjected to printing is a receipt (printing onto a receipt is also referred to as "receipt printing"), ruled lines are printed on the receipt. When ruled lines are printed, printing is required for all or almost all of the dot lines (for example, 576 dots), and hence the number of dots exceeds the number of simultaneously energizable dots (330 dots). In this case, divisional printing is performed two times in the related-art thermal printer. For example, in this thermal printer, the heat generating elements in the dot line are divided into two blocks (blocks each having 288 dots), and the divisional printing is performed for each block, that is, the divisional printing is performed two times.

As described above, in the related-art thermal printer, when the ruled lines are printed, the divisional printing is required to be performed several times, and thus the printing speed cannot be increased. Meanwhile, a large number of ruled lines are sometimes desired to be printed on the receipt, and a large number of receipts are printed in stores or other places. In such a case, the printing speed is reduced due to the divisional printing performed at the position of the ruled line, and thus the printing speed of the entire receipt is reduced.

In the printer TP1 according to the first embodiment, a large-capacity capacitor is arranged in addition to the power source. With this, when the capacitor is in a fully-charged state, printing is performed without division even for printing data that requires division when only the capacity of the power source is used, for example, an all-dot ruled line, as long as the printing is performed within predetermined dot lines. Collective printing performed for dot lines exceeding the number of simultaneously energizable dots only when the capacitor is fully charged is referred to as "expansion collective printing". In this case, when the expansion collective printing is performed one time, the expansion collective printing cannot be performed again until a feed is performed by an amount of predetermined dot lines. When printing data that requires division is printed again before a predetermined feed is performed, the divisional printing is performed.

Meanwhile, with regard to the ruled line used in the receipt or the like, in general, a blank of several dots or more (feed part) is often present before the ruled line is printed. The printer TP1 according to the first embodiment therefore determines whether or not the capacitor is in the fully-charged state during a period corresponding to the blank or the like present before the ruled line is printed also when the number of dots exceeds the number of simultaneously energizable dots. Then, when it is determined that the capacitor is in the fully-charged state, the printer TP1 performs the expansion collective printing. In this manner, the printer TP1 can perform printing without decreasing the speed.

Further, the printer TP1 determines whether or not the capacitor is in the fully-charged state with use of the number of feeds and time. In this manner, the printer TP1 can more easily determine whether to perform the divisional printing or the expansion collective printing as compared to a case in which a printing ratio or the like is calculated. That is, the printer TP1 can use a simpler circuit configuration for this determination and further reduce the memory capacity as compared to the case in which a printing ratio or the like is calculated. In the first embodiment, description is given of a case in which the printer TP1 determines whether or not the capacitor is in the fully-charged state with use of the number of feeds.

Figure 3:
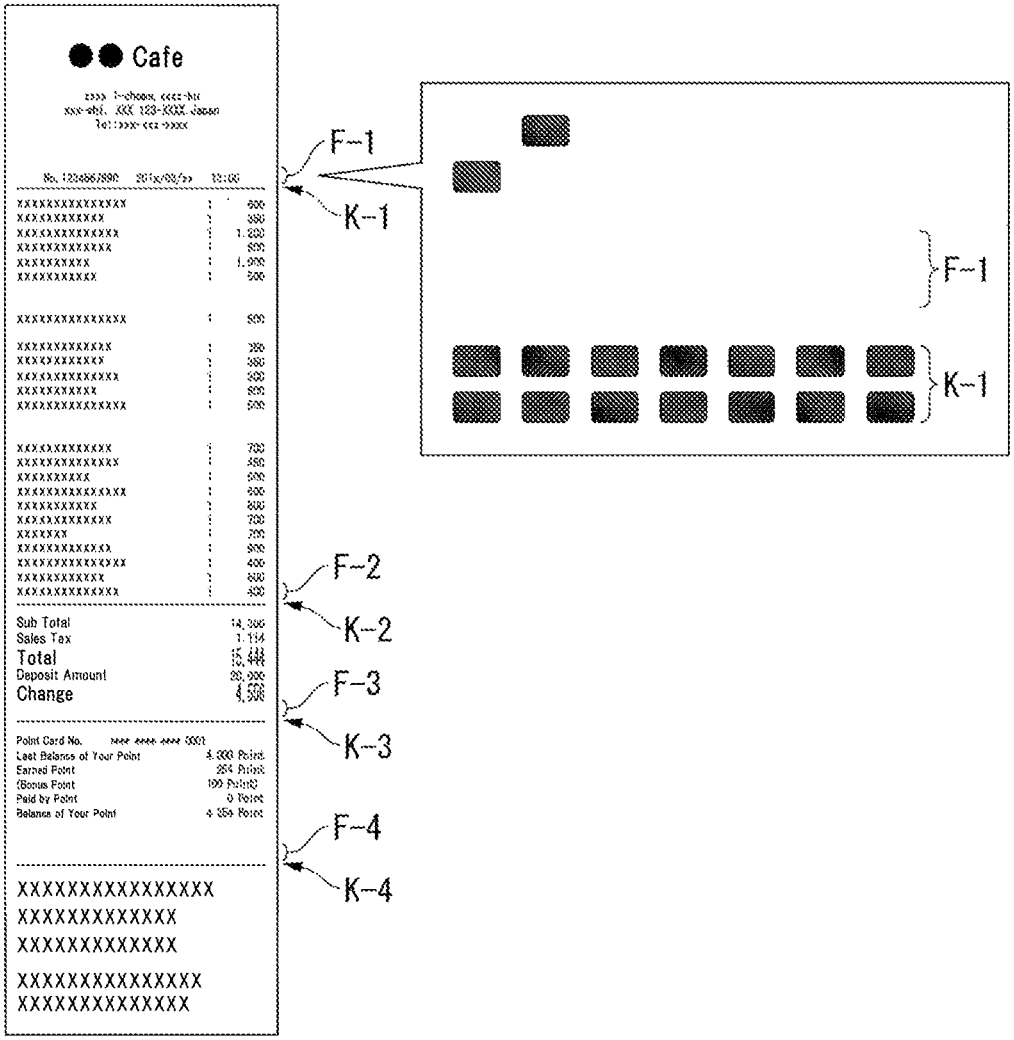
FIG. 3 is a diagram for illustrating an example of a receipt in the first embodiment.

FIG. 3 is a diagram for illustrating an example of the receipt in the first embodiment. The receipt illustrated in FIG. 3 has been subjected to printing for each dot line from top to bottom (direction opposite to the conveyance direction). The receipt illustrated in FIG. 3 has all-dot ruled lines K-1, K-2, K-3, and K-4 printed thereon. At immediately before (above) the all-dot ruled lines K-1, K-2, K-3, and K-4, a blank F-1, a blank F-2, a blank F-3, and a blank F-4 corresponding to a predetermined number of lines or more are present, respectively. In the receipt of the first embodiment, characters or the like may be printed before the ruled line. For example, in the receipt, dots that are smaller in number than the number of simultaneously energizable dots may be printed in a predetermined number of lines before the ruled line. That is, the printer TP1 can charge the capacitor when no printing is performed or when printing of dots that are smaller in number than the number of simultaneously energizable dots is performed. The printer TP1 can therefore charge the capacitor even in those cases, and as a result, determines whether or not the capacitor is in the fully-charged state.

Figure 4:
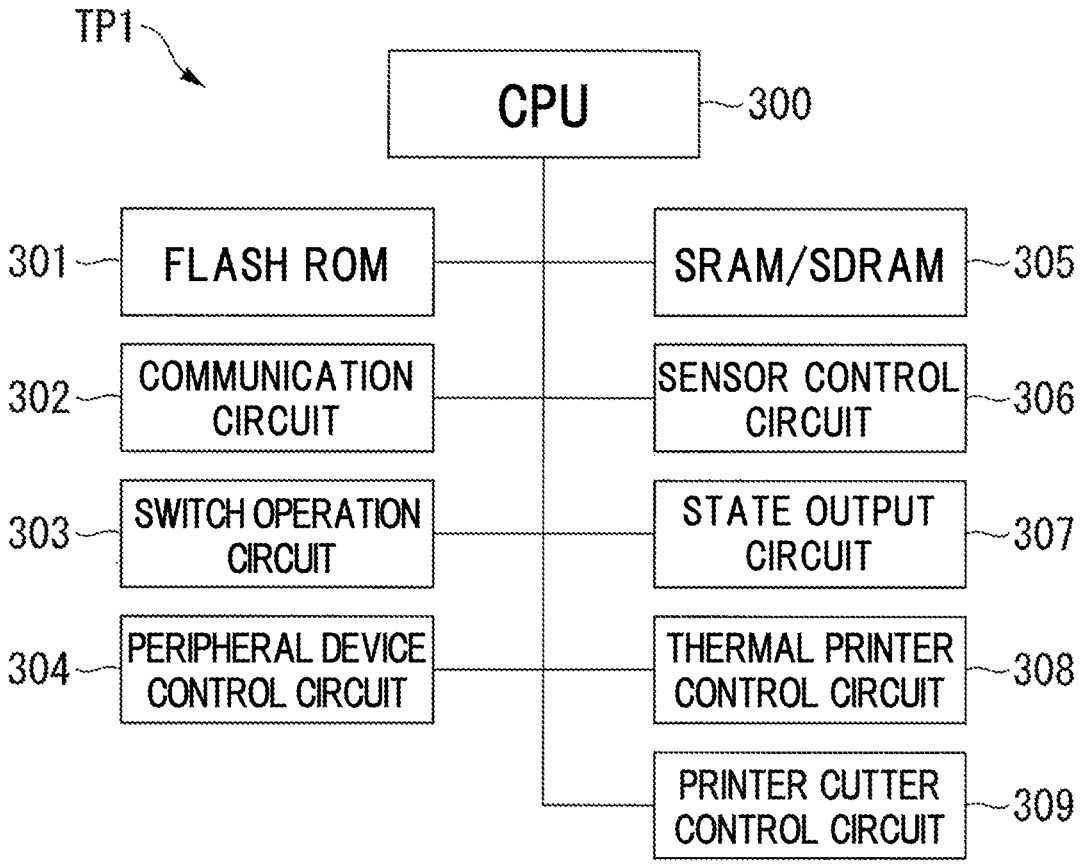
FIG. 4 is a schematic block diagram for illustrating an example of a hardware configuration of the printer according to the first embodiment.

FIG. 4 is a schematic block diagram for illustrating an example of a hardware configuration of the printer TP1 according to the first embodiment. The printer TP1 includes a CPU 300, a flash ROM 301, a communication circuit 302, a switch operation circuit 303, a peripheral device control circuit 304, an SRAM/SDRAM 305, a sensor control circuit 306, a state output circuit 307, a thermal printer control circuit 308, and a printer cutter control circuit 309. The CPU 300, the flash ROM 301, the communication circuit 302, the switch operation circuit 303, the peripheral device control circuit 304, the SRAM/SDRAM 305, the sensor control circuit 306, the state output circuit 307, the thermal printer control circuit 308, and the printer cutter control circuit 309 are connected to each other via a bus.

The CPU 300 performs various types of information processing and control of the printer TP1 in accordance with a predetermined program. The CPU 300 analyzes various types of data input from a host via the communication circuit 302 to execute each type of processing. The flash ROM 301 is externally arranged to store large-capacity data, for example, image data and font data. The CPU 300 reads out the image data and the font data from the flash ROM 301 to execute printing processing.

The communication circuit 302 is an interface for reading various types of data from a host 2 through wired or wireless communication. The switch operation circuit 303 receives input from a feed switch, a reset switch, a power switch, or other switches to execute the processing.

The peripheral device control circuit 304 controls peripheral devices (for example, a drawer, a buzzer, and a barcode reader) of the printer TP1. The SRAM/SDRAM 305 is used as a work area of a two-dimensional code or data on temporary printing, for example, page printing.

The sensor control circuit 306 determines various sensors. Examples of the various sensors include a paper detection sensor, a platen position sensor, a cutter sensor, a temperature sensor, a mark sensor, and a near-end sensor. The sensor control circuit 306 uses the determination result for adjustment of an error or printing control. The state output circuit 307 displays the state of the printer TP1. The state output circuit 307 is, for example, an LED or an LCD. The state output circuit 307 may output a sound. The thermal printer control circuit 308 performs printing processing. The printer cutter control circuit 309 performs sheet cut processing.

For example, the switch operation circuit 303 and the state output circuit 307 in the schematic block diagram of FIG. 4 illustrating an example of the hardware configuration of the printer TP1, correspond to the operation portion 24 and the state indication portion 77 in the perspective view of FIG. 1 illustrating the printer TP1, respectively.

Figure 5:
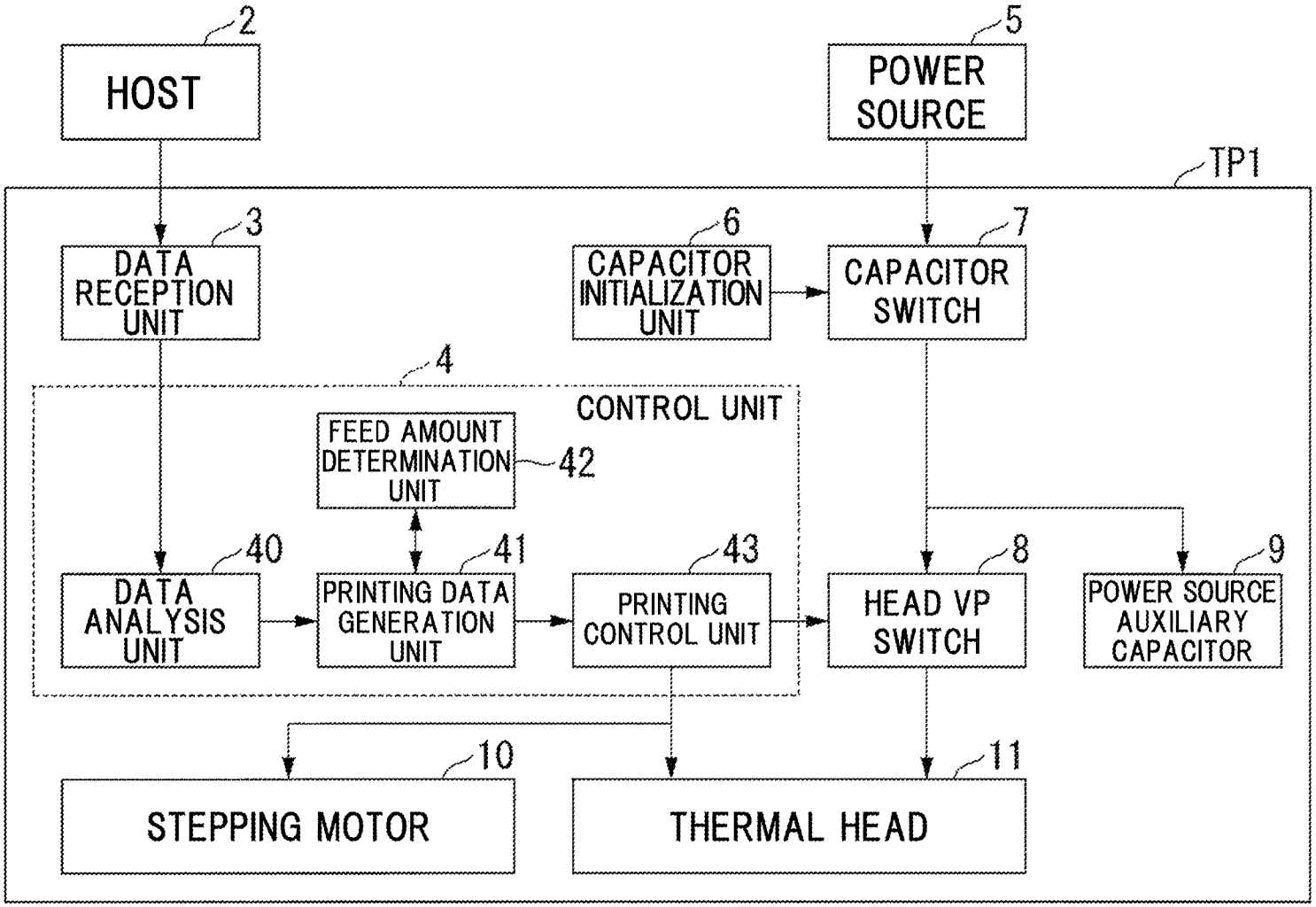
FIG. 5 is a schematic block diagram for illustrating an example of a logical configuration of the printer according to the first embodiment.

FIG. 5 is a schematic block diagram for illustrating an example of a logical configuration of the printer TP1 according to the first embodiment. FIG. 5 is an illustration of the logical configuration of the printer TP1 illustrated in FIG. 4. The printer TP1 includes a data reception unit 3, a control unit 4, a capacitor initialization unit 6, a capacitor switch 7, a head virtual path (VP) switch 8, a power source auxiliary capacitor 9, a stepping motor 10, and the thermal head 11.

A power source 5 supplies power to the printer TP1 via an AC adapter (not shown). The printer TP1 receives data from the external host 2. The printer TP1 operates by being supplied with power from the external power source 5.

The host 2 transmits data to the printer TP1. The data reception unit 3 receives the data from the host 2 to output the received data to a data analysis unit 40.

The control unit 4 includes the data analysis unit 40, a printing data generation unit 41, a feed amount determination unit 42, and a printing control unit 43. The control unit 4 controls the data analysis unit 40, the printing data generation unit 41, the feed amount determination unit 42, and the printing control unit 43.

The data analysis unit 40 acquires data from the data reception unit 3. This data is data indicating the image to be printed, and is, for example, bit strings arranged in the order of lines to indicate whether or not to perform printing in accordance with the order of dots in the lines. The data analysis unit 40 analyzes the acquired data in the order of reception, that is, the order to perform printing.

The printing data generation unit 41 acquires analysis information from the data analysis unit 40. When the analysis information indicates the printing data for the line in which the printing is performed, the printing data generation unit 41 converts the acquired data into printing task data. In this case, the printing task data refers to, for example, dot data or motor drive data to be transmitted to the head. The dot data refers to data indicating, in the order of lines, whether or not to cause the heat generator to generate heat in accordance with the order of dots in the lines. The printing data generation unit 41 outputs the printing task data to the printing control unit 43. Meanwhile, when the analysis information indicates feed data for the line in which the printing is performed, the printing data generation unit 41 outputs the acquired data to the feed amount determination unit 42.

In this case, the printing data generation unit 41 selects, as a printing method, any one of the expansion collective printing, the divisional printing, and a normal collective printing (described later) based on the number of printing dots and a value of a feed counter of the feed amount determination unit 42 to be described later. The printing data generation unit 41 counts, based on the dot data, the number of heat generating elements 15-*m* to be caused to generate heat in each time of printing, that is, the number of printing dots for the line in which the printing is performed. The printing data generation unit 41 selects the normal collective printing (described later) when the number of printing dots is equal to or smaller than the number of simultaneously energizable dots.

Meanwhile, when the number of printing dots exceeds the number of simultaneously energizable dots, the printing data generation unit 41 may select not only the divisional printing but also the expansion collective printing. At this time, when the printing data generation unit 41 determines that the value of the feed counter is equal to or larger than a predetermined value ("number of feeds to complete charging" to be described later), the printing data generation unit 41 selects the expansion collective printing. On the other hand, when the printing data generation unit 41 determines that the value of the feed counter is smaller than the predetermined number, the printing data generation unit 41 selects the divisional printing. That is, when the number of printing dots exceeds the number of simultaneously energizable dots, the printing data generation unit 41 further determines whether or not a predetermined amount of power is stored in the capacitor, and when the printing data generation unit 41 determines that the power amount is stored, the printing data generation unit 41 selects the expansion collective printing. On the other hand, when the printing data generation unit 41 determines that the predetermined amount of power is not stored in the capacitor at this time, the printing data generation unit 41 selects the divisional printing.

The printing data generation unit 41 generates the printing task data based on the selected printing method. For example, when the printing data generation unit 41 selects the expansion collective printing, the printing data generation unit 41 controls the thermal head to perform printing with use of the power from the power source and the power of the power source auxiliary capacitor based on the printing task data indicating the expansion collective printing. Meanwhile, when the printing data generation unit 41 selects the divisional printing or the normal collective printing (described later), the printing data generation unit 41 controls the thermal head to perform printing with use of the power from the power source without using the power of the power source auxiliary capacitor based on the printing task data indicating the divisional printing or the normal collective printing (described later).

The feed amount determination unit 42 counts the number of dot lines to be fed, that is, the number of lines indicating the number of lines of the blank. The feed amount determination unit 42 updates the number of lines (also referred to as "feed counter") based on the feed data acquired from the printing data generation unit 41. Specifically, the feed amount determination unit 42 increments the number of dot lines to be fed, that is, the feed counter, when the analysis information indicates the feed data for the line in which the printing is performed. Further, when the expansion collective printing is performed, that is, when the power of the capacitor is consumed, the feed amount determination unit 42 resets the feed counter. In other words, the printer TP1 determines that the capacitor is charged when the feed is performed, and counts the number of feeds, to thereby measure a period in which the capacitor is charged or the amount of power charged in the capacitor. The feed amount determination unit 42 may increment the feed counter when the divisional printing or the normal collective printing (described later) is performed. That is, when the divisional printing or the normal collective printing (described later) is performed, the power source is used for printing. Also in this case, when the capacitor can be continuously charged, the feed amount determination unit 42 increments the feed counter. The feed amount determination unit 42 outputs the value of the feed counter to the printing data generation unit 41 in response to a request from the printing data generation unit 41.

The printing control unit 43 executes printing based on the printing task data acquired from the printing data generation unit 41. That is, the printing control unit 43 executes any one of the expansion collective printing, the divisional printing, and the normal collective printing (described later) based on the printing task data. The printing control unit 43 drives the stepping motor 10, transmits data to the thermal head 11, controls energization to the thermal head 11, and controls the head VP switch 8 to execute the printing.

The capacitor initialization unit 6 performs charge chopping control to the power source auxiliary capacitor 9 via the capacitor switch 7 when the power is turned on or the reset is canceled. The capacitor switch 7 controls the current flowing to the power source auxiliary capacitor 9. The head VP switch 8 controls the current flowing to the integrated circuit in the thermal head 11. The capacitor switch 7 and the head VP switch 8 are field effect transistors (FETs). The power source auxiliary capacitor 9 is controlled by the capacitor switch 7 to store power.

Figure 6:
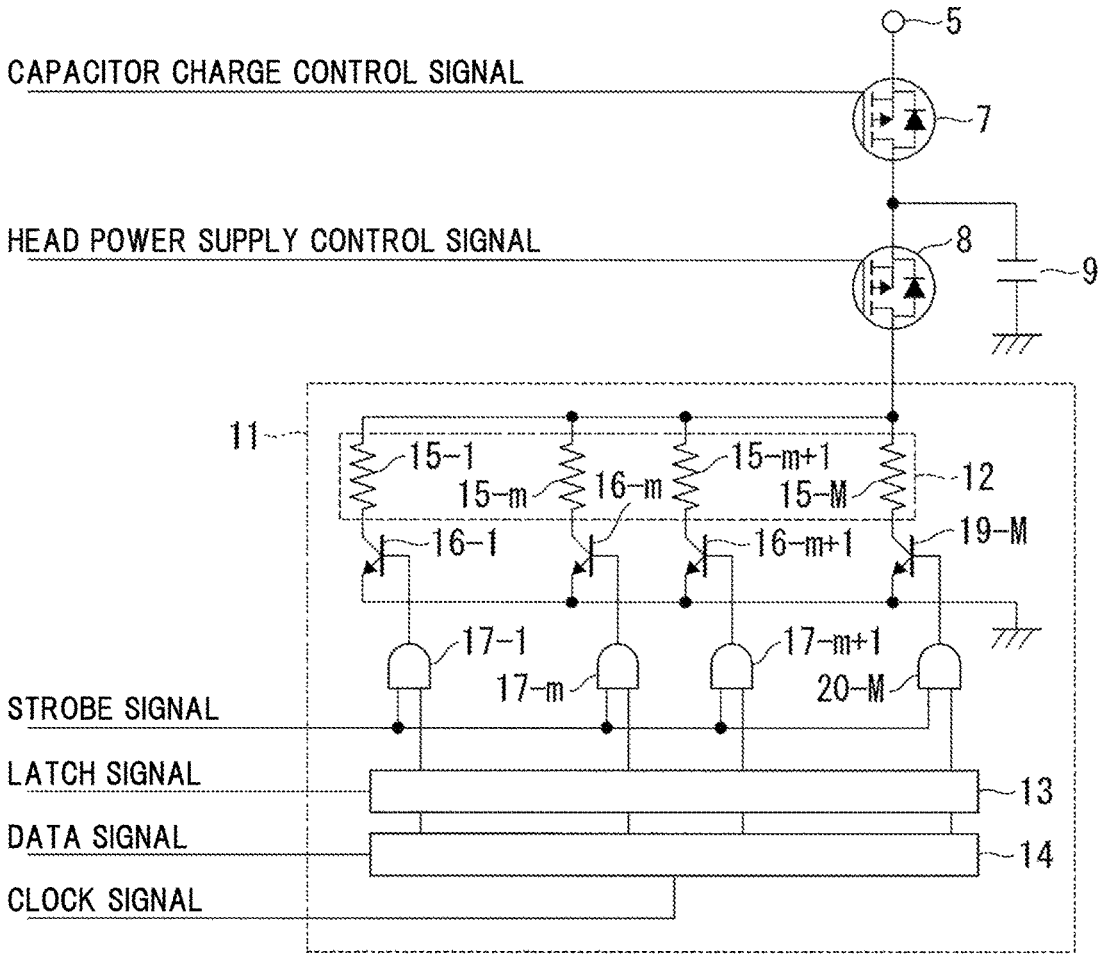
FIG. 6 is a circuit diagram for illustrating an example of a configuration of a driver integrated circuit in the first embodiment.

FIG. 6 is a circuit diagram for illustrating an example of a configuration of a driver integrated circuit in the first embodiment. The driver integrated circuit in the first embodiment includes the capacitor switch 7, the head VP switch 8, the power source auxiliary capacitor 9, and the thermal head 11.

The capacitor initialization unit 6 transmits a capacitor charge control signal to the capacitor switch 7 to cause the capacitor switch 7 to switch between an on state and an off state. When the capacitor switch 7 is in the on state, the power source auxiliary capacitor 9 is charged. When the capacitor switch 7 is in the off state, the charging of the power source auxiliary capacitor 9 is stopped.

The capacitor initialization unit 6 controls the charging from the power source 5 to the power source auxiliary capacitor 9 via the capacitor switch 7. When the electric capacitance of the power source auxiliary capacitor 9 is large, the capacitor initialization unit 6 performs chopping control. The capacitor initialization unit 6 performs the chopping control to prevent a large current from flowing to the power source auxiliary capacitor 9. When the inflow current is sufficiently small, the capacitor initialization unit 6 is not required to perform the chopping control.

The printing control unit 43 transmits a head power supply control signal to the head VP switch 8 to cause the head VP switch 8 to switch between an on state and an off state. When the head VP switch 8 is in the on state, power is supplied to the thermal head 11. When the head VP switch 8 is in the off state, the power supply to the thermal head 11 is stopped. The printing control unit 43 transmits the head power supply control signal to the head VP switch 8 at the time of printing to supply power to the thermal head 11.

When the heat generating elements 15 that are larger in number than the number of simultaneously energizable dots are to be used, the printing control unit 43 controls the head VP switch 8 so that the power from the power source 5 and the power stored in the power source auxiliary capacitor 9 are supplied to the thermal head 11. Meanwhile, when the heat generating elements 15 that are equal to or smaller in number than the number of simultaneously energizable dots are to be used, the printing control unit 43 controls the head VP switch 8 so that the power from the power source 5 is supplied to the thermal head 11. The printing control unit 43 transmits the head power supply control signal to the head VP switch 8 when the printing is ended, to thereby stop the power supply to the thermal head 11. The printing control unit 43 stops the power supply to the thermal head 11 when the printing is ended to avoid electrolytic corrosion of the thermal head.

The thermal head 11 includes a thermal head heat generator 12, a latch register 13, a shift register 14, the heat generating elements 15, transistors 16, and AND gates 17. The heat generating elements 15 are formed of M heat generating elements 15-*m* (m=1, 2, . . . , M, where M is a natural number). The transistors 16 are formed of M transistors 16-*m* (m=1, 2, . . . , M, where M is a natural number). The AND gates 17 are formed of M AND gates 17-*m* (m=1, 2, . . . , M, where M is a natural number). In this case, M is, for example, 576. The configuration of the thermal head shown here is merely an example. For example, a configuration in which NAND gates are used instead of the AND gates 17 may be employed. In the case of the configuration of the first embodiment, voltage is applied to the heat generating elements 15 when a polarity of a strobe signal is High. In the case of the configuration in which the NAND gates are employed instead of the AND gates 17, voltage is applied to the heat generating elements 15 when the polarity of the strobe signal is Low.

The printing control unit 43 transmits various signals to the thermal head 11 to control the energization of the thermal head heat generator 12. The capacitor initialization unit 6 and the printing control unit 43 turn on the capacitor switch 7 and the head VP switch 8, respectively, so that the thermal head 11 can be energized. The printing control unit 43 transmits a data signal synchronizing with a clock signal to the shift register 14 to transfer data to the shift register 14.

The printing control unit 43 confirms the data of the shift register 14 through an operation of a latch signal to load the data to the latch register 13. The latch register 13 inputs the loaded data to one input terminal of each of the AND gates 17. The printing control unit 43 inputs the strobe signal responsible for the energization of each dot to one input terminal of the corresponding AND gate 17. The AND gate 17 outputs an output signal to a base of the corresponding transistor 16. Voltage is applied to the heat generating element 15 corresponding to each transistor 16, and thus each of the heat generating elements 15 generates heat.

When the expansion collective printing is performed, the printing control unit 43 causes the heat generating elements 15 that are larger in number than the number of simultaneously energizable dots to generate heat. Meanwhile, when the divisional printing is performed, the printing control unit 43 causes the heat generating elements 15 that are equal to or smaller in number than the number of simultaneously energizable dots to generate heat. In this case, the heat generating elements 15 that are equal to or smaller in number than the number of simultaneously energizable dots correspond to at least one block obtained when the heat generating elements 15 that are larger in number than the number of simultaneously energizable dots are divided into a plurality of blocks.

Figure 7:
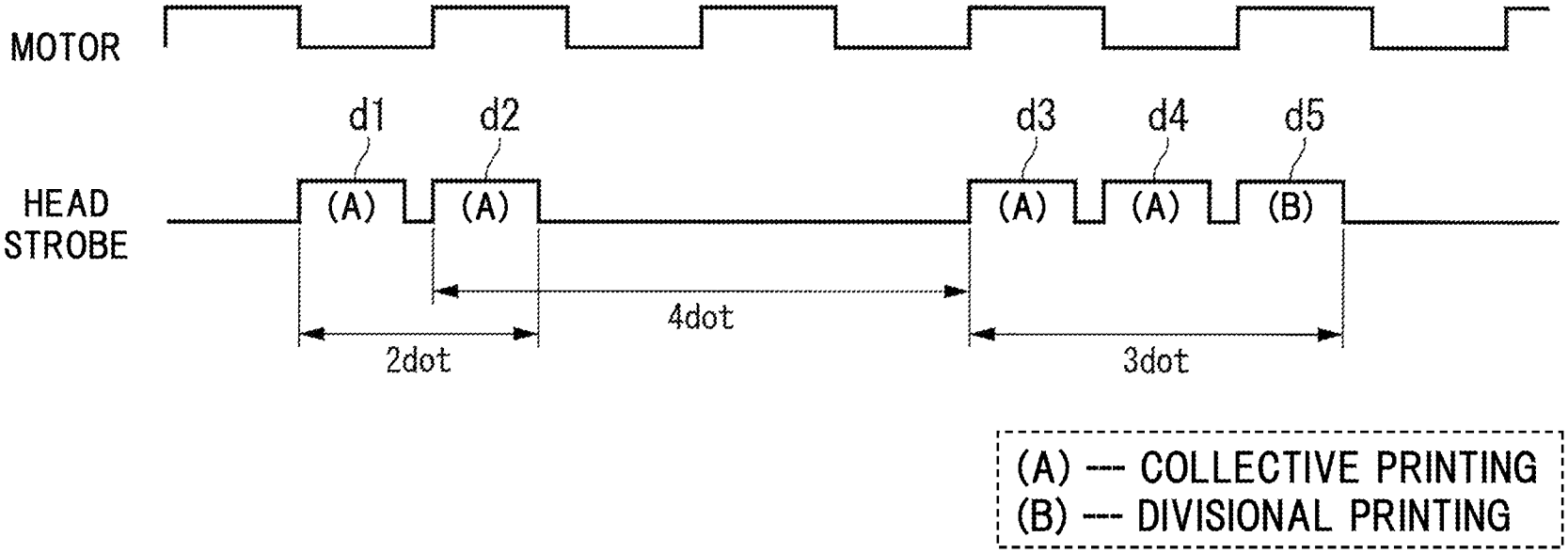
FIG. 7 is a timing chart for illustrating an example of head drive control using feeds in the first embodiment.

FIG. 7 is a timing chart for illustrating an example of head drive control using feeds in the first embodiment. With reference to FIG. 7, description is given of how the printing control unit 43 of FIG. 5 controls drive of the thermal head 11. In FIG. 7, an upper limit number of dot lines is set to 2 dots. In this case, the upper limit number of dot lines refers to the upper limit of the number of dot lines each energized in all dots that can be successively and collectively printed while also using the power source auxiliary capacitor 9. The upper limit number of dot lines is limited by the capacity of the power source auxiliary capacitor 9. Further, the number of feeds to complete charging is set to 4 dots. In this case, the number of feeds to complete charging refers to the number of dot lines to be fed until the re-charging of the power source auxiliary capacitor 9 is completed. The number of dot lines each energized in all dots that can be successively and collectively printed and the number of feeds to complete charging are defined based on results of experiments or the like. In FIG. 7, it is assumed that dot lines corresponding to a sufficient number of feeds are present before a dot line d1.

The expansion collective printing can be successively performed until 2 dots, and hence the expansion collective printing is performed in the dot line d1 and a dot line d2. There are feeds corresponding to 4 dots before the printing of a dot line d3, and hence the expansion collective printing can be performed. The expansion collective printing is therefore performed in the dot line d3 and a dot line d4. The upper limit of the expansion collective printing is 2 dots, and hence the divisional printing is performed in a third dot line d5 and the subsequent dot lines.

Figure 8:
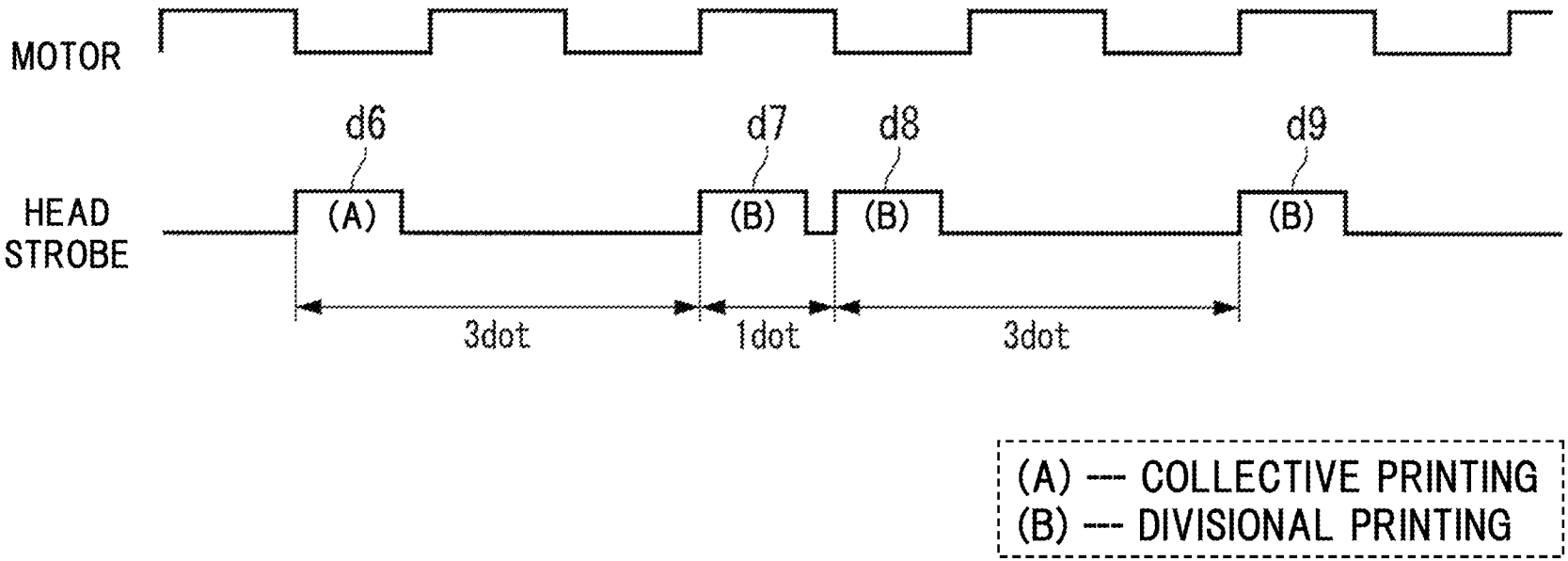
FIG. 8 is a timing chart for illustrating another example of the head drive control using feeds in the first embodiment.

FIG. 8 is a timing chart for illustrating another example of the head drive control using feeds in the first embodiment. With reference to FIG. 8, description is given of how the printing control unit 43 of FIG. 5 controls drive of the thermal head 11. In a dot line d6, the expansion collective printing is performed. Feeds corresponding to 4 dots are not present before the printing of a dot line d7, and hence the expansion collective printing cannot be performed. The divisional printing is therefore performed in the dot line d7. In a dot line d8, because the divisional printing is performed in the dot line d7, the divisional printing of the remaining printing data of the same line is performed. In a dot line d9, feeds corresponding to 4 dots are not present before the printing of the dot line d9, and hence the expansion collective printing cannot be performed. The divisional printing is therefore performed in the dot line d9.

Figure 9:
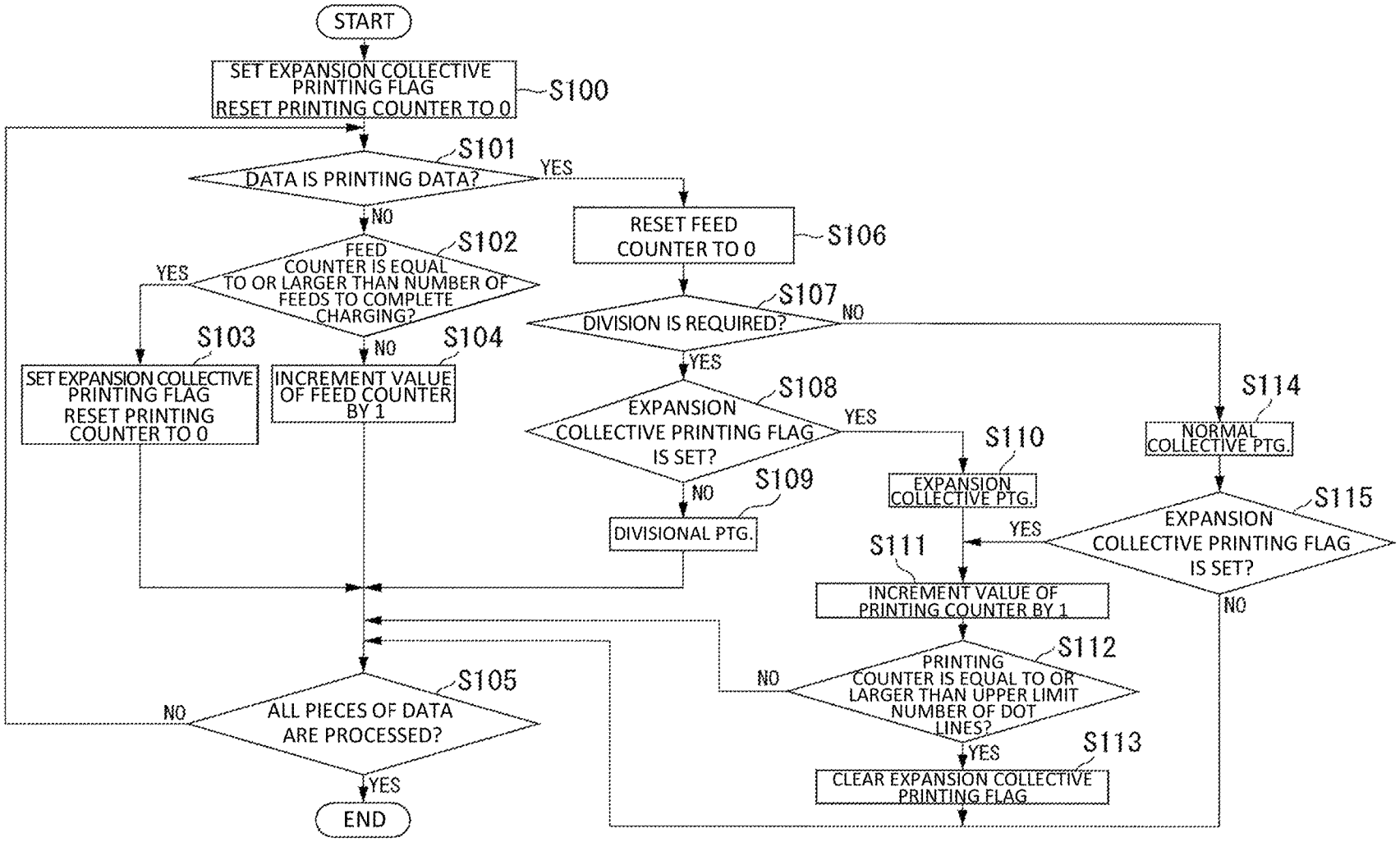
FIG. 9 is a flow chart for illustrating an example of processing in printing control using feeds in the first embodiment.

FIG. 9 is a flow chart for illustrating an example of processing in printing control using feeds in the first embodiment. The processing illustrated in the flow chart is executed when the printer TP1 receives data from the host 2. It is assumed that the power source auxiliary capacitor 9 is in the fully-charged state when the processing is started.

(Step S100) The printing data generation unit 41 sets an expansion collective printing flag. In this case, the expansion collective printing flag refers to a flag indicating whether or not the expansion collective printing can be performed in the processing illustrated in the flow chart. When the expansion collective printing flag is set, the printing data generation unit 41 determines that the power source auxiliary capacitor 9 is in the fully-charged state and the expansion collective printing can be performed. Meanwhile, when the expansion collective printing flag is cleared, the printing data generation unit 41 determines that the power source auxiliary capacitor 9 is not in the fully-charged state and the expansion collective printing cannot be performed. The printing data generation unit 41 resets a printing counter to 0. In this case, the printing counter refers to an amount for counting the number of times in which the expansion collective printing is performed. The upper limit number of dot lines is, for example, 2 dots. After that, the printing data generation unit 41 executes the processing of Step S101.

(Step S101) The printing data generation unit 41 acquires the analysis information from the data analysis unit 40. The printing data generation unit 41 determines whether the data is printing data or feed data based on the acquired analysis information. The feed data includes printing data of dot lines having no printing dot. When the analysis information indicates that the data is the printing data (YES), the printing data generation unit 41 executes the processing of Step S106. Meanwhile, when the analysis information indicates that the data is the feed data (NO), the printing data generation unit 41 executes the processing of Step S102.

(Step S102) The printing data generation unit 41 acquires the value of the feed counter from the feed amount determination unit 42. The printing data generation unit 41 determines whether or not the feed counter is equal to or larger than the number of feeds to complete charging. When the printing data generation unit 41 determines that the feed counter is equal to or larger than the number of feeds to complete charging (YES), the printing data generation unit 41 executes the processing of Step S103. On the other hand, when the printing data generation unit 41 determines that the feed counter is not equal to or larger than the number of feeds to complete charging (NO), the printing data generation unit 41 executes the processing of Step S104.

(Step S103) The printing data generation unit 41 sets the expansion collective printing flag. The printing data generation unit 41 resets the value of the printing counter to 0. After that, the feed amount determination unit 42 executes the processing of Step S105.

(Step S104) The printing data generation unit 41 outputs the acquired data to the feed amount determination unit 42. When the data (feed data) is input to the feed amount determination unit 42, the feed amount determination unit 42 increments the value of the feed counter by 1. After that, the printing data generation unit 41 executes the processing of Step S105.

(Step S105) The printing data generation unit 41 determines whether or not all pieces of data are processed. When the printing data generation unit 41 determines that all pieces of data are processed (YES), the printing data generation unit 41 ends the processing. Meanwhile, when the printing data generation unit 41 determines that unprocessed data remains (NO), the printing data generation unit 41 executes the processing of Step S101.

(Step S106) The printing data generation unit 41 outputs, to the feed amount determination unit 42, a feed counter reset signal indicating a command to reset the value of the feed counter to 0. When the feed counter reset signal is input to the feed amount determination unit 42, the feed amount determination unit 42 resets the value of the feed counter to 0. After that, the printing data generation unit 41 executes the processing of Step S107.

(Step S107) The printing data generation unit 41 determines whether or not the divisional printing is required through comparison between the number of black dots in the printing data and the number of simultaneously energizable dots. When the number of printing dots exceeds the number of simultaneously energizable dots, the printing data generation unit 41 determines that the divisional printing is required. When the printing data generation unit 41 determines that the divisional printing is required (YES), the printing data generation unit 41 executes the processing of Step S108. On the other hand, when the number of printing dots does not exceed the number of simultaneously energizable dots, the printing data generation unit 41 determines that the divisional printing is not required. When the printing data generation unit 41 determines that the divisional printing is not required (NO), the printing data generation unit 41 executes the processing of Step S114.

(Step S108) The printing data generation unit 41 determines whether or not the expansion collective printing flag is set. When the printing data generation unit 41 determines that the expansion collective printing flag is set (YES), the printing data generation unit 41 determines that the power source auxiliary capacitor 9 is in the fully-charged state and the expansion collective printing can be performed. After that, the printing data generation unit 41 executes the processing of Step S110. Meanwhile, when the printing data generation unit 41 determines that the expansion collective printing flag is cleared (NO), the printing data generation unit 41 determines that the power source auxiliary capacitor 9 is not in the fully-charged state and the expansion collective printing cannot be performed. After that, the printing data generation unit 41 executes the processing of Step S109. Description is given of a case in which the printing data generation unit 41 determines whether or not the power source auxiliary capacitor 9 is in the fully-charged state, but the printing data generation unit 41 may determine whether or not a predetermined amount of power is stored in the power source auxiliary capacitor 9.

(Step S109) The printing data generation unit 41 generates the printing task data based on the printing method of divisional printing. The printing data generation unit 41 outputs the printing task data to the printing control unit 43. The printing control unit 43 executes the divisional printing based on the acquired printing task data. After that, the printing data generation unit 41 executes the processing of Step S105.

(Step S110) The printing data generation unit 41 generates the printing task data based on the printing method of expansion collective printing. The printing data generation unit 41 outputs the printing task data to the printing control unit 43. The printing control unit 43 executes the expansion collective printing based on the acquired printing task data. After that, the printing data generation unit 41 executes the processing of Step S111.

(Step S111) The printing data generation unit 41 increments the value of the printing counter by 1, and executes the processing of Step S112.

(Step S112) The printing data generation unit 41 determines whether or not the value of the printing counter is equal to or larger than the upper limit number of dot lines. When the printing data generation unit 41 determines that the value of the printing counter is equal to or larger than the upper limit number of dot lines (YES), the printing data generation unit 41 executes the processing of Step S113. On the other hand, when the printing data generation unit 41 determines that the value of the printing counter is not equal to or larger than the upper limit number of dot lines (NO), the printing data generation unit 41 executes the processing of Step S105.

(Step S113) The printing data generation unit 41 clears the expansion collective printing flag. After that, the printing data generation unit 41 executes the processing of Step S105.

(Step S114) The printing data generation unit 41 generates the printing task data based on the printing method of normal collective printing. The printing data generation unit 41 outputs the printing task data to the printing control unit 43. The printing control unit 43 executes the normal collective printing based on the acquired printing task data. In this case, the normal collective printing represents collective printing performed to the dot line not exceeding the number of simultaneously energizable dots. After that, the printing data generation unit 41 executes the processing of Step S115.

(Step S115) The printing data generation unit 41 determines whether or not the expansion collective printing flag is set. When the printing data generation unit 41 determines that the expansion collective printing flag is set (YES), the printing data generation unit 41 executes the processing of Step S111. Meanwhile, when the printing data generation unit 41 determines that the expansion collective printing flag is cleared (NO), the printing data generation unit 41 executes the processing of Step S105.

As described in Step S107, the printing control unit 43 is controlled based on the printing task data to select whether to perform printing with use of the heat generating elements 15 that are larger in number than the number of simultaneously energizable dots or to perform printing with use of the heat generating elements 15 that are equal to or smaller in number than the number of simultaneously energizable dots. Further, the printing data generation unit 41 is controlled as follows. The printing data generation unit 41 determines whether or not the amount of power corresponding to the fully-charged state is stored in the power source auxiliary capacitor 9. When the printing data generation unit 41 determines that the amount of power corresponding to the fully-charged state is stored in the power source auxiliary capacitor 9, the printing data generation unit 41 allows printing with use of at least a part of the first group of the heat generators (heat generating elements 15 that are larger in number than the number of simultaneously energizable dots). When the printing data generation unit 41 determines that the amount of power corresponding to the fully-charged state is not stored in the capacitor (power source auxiliary capacitor 9), the printing data generation unit 41 allows printing with use of at least a part of the second group of the heat generators (heat generating elements 15 that are equal to or smaller in number than the number of simultaneously energizable dots) (Step S108).

The divisional printing or the normal collective printing is not affected by the state of charge of the power source auxiliary capacitor 9. That is, when the divisional printing or the normal collective printing is performed, the power of the power source auxiliary capacitor 9 is not used. Further, when the divisional printing or the normal collective printing is performed, the power source auxiliary capacitor 9 is not charged. When the divisional printing or the normal collective printing is performed, the power source auxiliary capacitor 9 may be charged.

As described above, the printer TP1 according to the first embodiment includes the thermal head 11, the capacitor (power source auxiliary capacitor 9), the control circuit (printing data generation unit 41), and the drive circuit (head VP switch 8). The thermal head 11 causes the first group of the heat generators (heat generating elements 15 that are larger in number than the number of simultaneously energizable dots) or the second group of the heat generators (heat generating elements 15 that are equal to or smaller in number than the number of simultaneously energizable dots), which are smaller in number than the number of heat generators in the first group, to generate heat. The capacitor (power source auxiliary capacitor 9) stores power. The control circuit (printing data generation unit 41) is controlled based on the printing data to select whether to perform printing with use of the first group of the heat generators (heat generating elements 15 that are larger in number than the number of simultaneously energizable dots) or to perform printing with use of the second group of the heat generators (heat generating elements 15 that are equal to or smaller in number than the number of simultaneously energizable dots) (Step S107).

Further, the control circuit (printing data generation unit 41) is controlled as follows. The control circuit (printing data generation unit 41) determines whether or not the predetermined amount of power is stored in the capacitor (power source auxiliary capacitor 9). When the control circuit (printing data generation unit 41) determines that the predetermined amount of power is stored in the capacitor (power source auxiliary capacitor 9), the control circuit (printing data generation unit 41) allows printing with use of at least a part of the first group of the heat generators (heat generating elements 15 that are larger in number than the number of simultaneously energizable dots). When the control circuit (printing data generation unit 41) determines that the predetermined amount of power is not stored in the capacitor (power source auxiliary capacitor 9), the control circuit (printing data generation unit 41) allows printing with use of at least a part of the second group of the heat generators (heat generating elements 15 that are equal to or smaller in number than the number of simultaneously energizable dots) (Step S108).

The drive circuit (head VP switch 8) is controlled as follows. When the first group of the heat generators (heat generating elements 15 that are larger in number than the number of simultaneously energizable dots) are used, the drive circuit (head VP switch 8) supplies the power of the power source and the power stored in the capacitor (power source auxiliary capacitor 9) to the thermal head 11. When the second group of the heat generators (heat generating elements 15 that are equal to or smaller in number than the number of simultaneously energizable dots) are used, the drive circuit (head VP switch 8) supplies the power of the power source (power of the power source 5) to the thermal head 11.

With this configuration, the printer TP1 can perform control of whether to perform printing with use of the first group of the heat generators or to perform printing with use of the second group of the heat generators in accordance with whether or not the predetermined amount of power is stored in the capacitor. The printer TP1 can therefore control the heat generators in accordance with the amount of power stored in the capacitor. In control of the related art, the printing speed has been 270.9 mm/s, but in the printer TP1 according to the first embodiment, the printing speed is improved to 296.9 mm/s.

Further, the control circuit (printing data generation unit 41) is controlled as follows. The control circuit (printing data generation unit 41) calculates the number of heat generators (heat generating elements 15) to be caused to generate heat based on the printing data, and allows printing with use of at least a part of the second group of the heat generators (heat generating elements 15 that are equal to or smaller in number than the number of simultaneously energizable dots) when the calculated number of heat generators (heat generating elements 15) is equal to or smaller than a threshold value (number of simultaneously energizable dots). When the calculated number of heat generators (heat generating elements 15) is larger than the threshold value (number of simultaneously energizable dots), and the control circuit (printing data generation unit 41) determines that the predetermined amount of power is stored in the capacitor (power source auxiliary capacitor 9), the control circuit (printing data generation unit 41) allows printing with use of at least a part of the first group of the heat generators (heat generating elements 15 that are larger in number than the number of simultaneously energizable dots). When the control circuit (printing data generation unit 41) determines that the predetermined amount of power is not stored in the capacitor (power source auxiliary capacitor 9), the control circuit (printing data generation unit 41) allows printing with use of at least a part of the second group of the heat generators (heat generating elements 15 that are equal to or smaller in number than the number of simultaneously energizable dots).

With this configuration, the printer TP1 can select whether to perform printing with use of the second group of the heat generators based on the number of heat generators to be caused to generate heat. The printer TP1 can therefore control the heat generators in accordance with the amount of power stored in the capacitor.

Further, the thermal head 11 causes the first group of the heat generators (heat generating elements 15 that are larger in number than the number of simultaneously energizable dots) to generate heat or causes the second group of the heat generators (heat generating elements 15 that are equal to or smaller in number than the number of simultaneously energizable dots) to generate heat. The second group of the heat generators (heat generating elements 15 that are equal to or smaller in number than the number of simultaneously energizable dots) correspond to at least one block obtained when the first group of the heat generators (heat generating elements 15 that are larger in number than the number of simultaneously energizable dots) are divided into a plurality of blocks. The control circuit (printing data generation unit 41) is controlled as follows. The control circuit (printing data generation unit 41) calculates the number of heat generators (heat generating elements 15) to be caused to generate heat in one row of the thermal head 11. When the calculated number of heat generators (heat generating elements 15) is equal to or smaller than an upper limit value (number of simultaneously energizable dots) of the number of heat generators that can be printed by the power of the power source (power of the power source 5), the control circuit (printing data generation unit 41) allows printing with use of at least a part of the first group of the heat generators (heat generating elements 15 that are larger in number than the number of simultaneously energizable dots). When the calculated number of heat generators (heat generating elements 15) is larger than the upper limit value (number of simultaneously energizable dots) of the number of heat generators that can be printed by the power of the power source (power of the power source 5) and the control circuit (printing data generation unit 41) determines that the predetermined amount of power is stored in the capacitor (power source auxiliary capacitor 9), the control circuit (printing data generation unit 41) allows printing with use of at least a part of the first group of the heat generators (heat generating elements 15 that are larger in number than the number of simultaneously energizable dots). When the control circuit (printing data generation unit 41) determines that the predetermined amount of power is not stored in the capacitor (power source auxiliary capacitor 9), the control circuit (printing data generation unit 41) allows printing with use of at least a part of the second group of the heat generators (heat generating elements 15 that are equal to or smaller in number than the number of simultaneously energizable dots).

With this configuration, the printer TP1 can perform printing while the first group of the heat generators is divided into a plurality of blocks in one row of the thermal head when the calculated number of heat generators is larger than the upper limit value of the number of heat generators that can be printed by the power of the power source. The printer TP1 can thus control the heat generators in accordance with the amount of power stored in the capacitor.

Further, the control circuit (printing data generation unit 41) is controlled to determine that the predetermined amount of power is stored in the capacitor (power source auxiliary capacitor 9) when a printing medium is conveyed by an amount that is equal to or larger than a predetermined movement amount after the capacitor (power source auxiliary capacitor 9) supplies power to the thermal head 11 (Step S108). With this configuration, the printer TP1 can determine the state of charge of the capacitor based on only the movement amount of the conveyed printing medium, and hence the printer TP1 can control the heat generators in accordance with the amount of power stored in the capacitor.

Further, the printer TP1 according to the first embodiment further includes a counting unit (feed amount determination unit 42) configured to count the number of lines of printing. The control circuit (printing data generation unit 41) is controlled to determine that the predetermined amount of power is stored in the capacitor (power source auxiliary capacitor 9) when the printing medium is conveyed by an amount that is equal to or larger than the predetermined number of lines (number of feeds to complete charging) after the capacitor (power source auxiliary capacitor 9) supplies power to the thermal head 11 (Step S108).

With this configuration, the printer TP1 can determine the state of charge of the capacitor based on only the number of lines of the conveyed printing medium, and hence the printer TP1 can control the heat generators in accordance with the amount of power stored in the capacitor.

Further, the printer TP1 according to the first embodiment includes a conveyance mechanism configured to convey the printing medium (heat-sensitive paper P), and the head drive device. The heat generators (heat generating elements 15) are arranged in one row that is orthogonal to the conveyance direction of the printing medium (heat-sensitive paper P). The drive circuit controls the speed at which the conveyance mechanism conveys the printing medium (heat-sensitive paper P). With this configuration, the printer TP1 can control the speed at which the conveyance mechanism conveys the printing medium by the drive circuit, and hence the printer TP1 can control the heat generators in accordance with the amount of power stored in the capacitor.

Now, a second embodiment of the present invention is described in detail with reference to the drawings. In the above-mentioned first embodiment, description has been given of a case in which the printer TP1 determines whether or not the predetermined amount of power is stored in the power source auxiliary capacitor based on the predetermined number of feeds. In the second embodiment, description is given of a case in which the printer TP1 determines whether or not the predetermined amount of power is stored in the power source auxiliary capacitor based on a measured time and a predetermined storage time. In the following, a printer according to the second embodiment is referred to as "printer TP1*a*".

Figure 10:
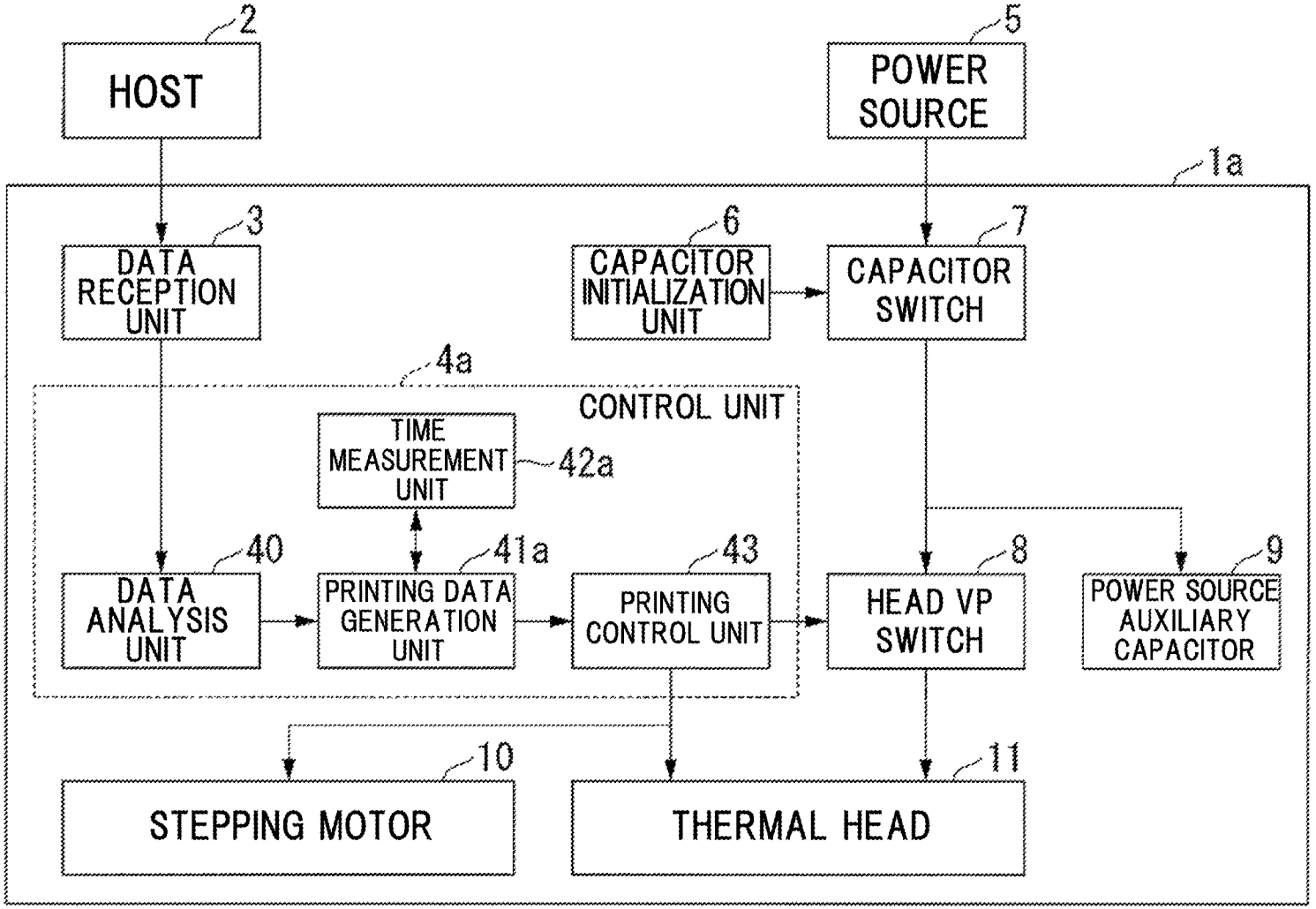
FIG. 10 is a schematic block diagram for illustrating an example of a configuration of a thermal printer control unit in a second embodiment of the present invention.

FIG. 10 is a schematic block diagram for illustrating an example of a configuration of a thermal printer control unit in the second embodiment of the present invention. The configuration of the thermal printer control unit 1 in the first embodiment (FIG. 2) differs from the configuration of a thermal printer control unit 1*a* in the second embodiment (FIG. 10) in a time measurement unit 42*a*. Other configurations are similar to those of the thermal printer control unit 1 in the first embodiment, and hence description thereof is omitted. In the second embodiment, parts different from the first embodiment are mainly described.

The thermal printer control unit 1*a* includes the data reception unit 3, a control unit 4*a*, the capacitor initialization unit 6, the capacitor switch 7, the head VP switch 8, the power source auxiliary capacitor 9, the stepping motor 10, and the thermal head 11.

The control unit 4*a* includes the data analysis unit 40, the printing data generation unit 41*a*, the time measurement unit 42*a*, and the printing control unit 43. The control unit 4*a* controls the data analysis unit 40, the printing data generation unit 41*a*, the time measurement unit 42*a*, and the printing control unit 43. The time measurement unit 42*a* measures a storage time of the power source auxiliary capacitor 9 after the power source auxiliary capacitor 9 supplies power to the thermal head 11. The time measurement unit 42*a* outputs the measured storage time to the printing data generation unit 41*a* in response to a request from the printing data generation unit 41*a*. The printing data generation unit 41*a* determines whether or not the predetermined amount of power is stored in the power source auxiliary capacitor 9 through comparison between the measured time acquired by the time measurement unit 42*a* and a predetermined storage time.

Figure 11:
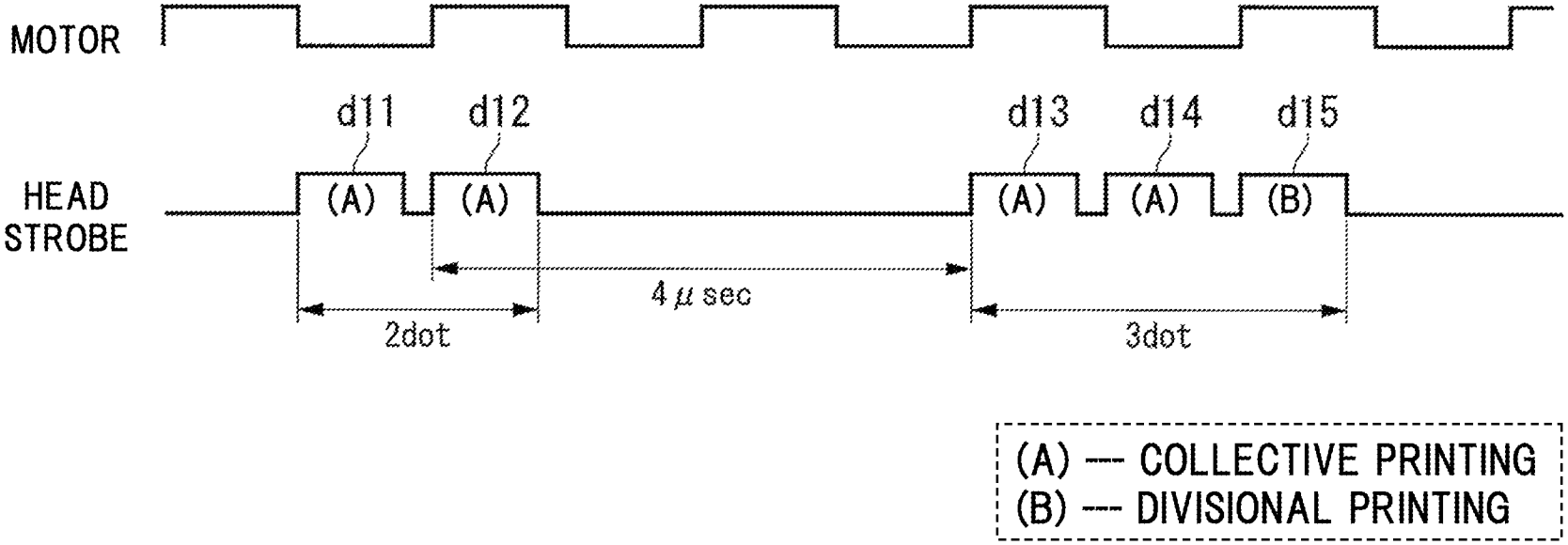
FIG. 11 is a timing chart for illustrating an example of head drive control using time measurement in the second embodiment.

FIG. 11 is a timing chart for illustrating an example of head drive control using time measurement in the second embodiment. With reference to FIG. 11, description is given of how the printing control unit 43 of FIG. 10 controls drive of the thermal head 11. In FIG. 11, the upper limit number of dot lines is set to 2 dots. Further, a charge complete time, which is a time until the re-charging of the power source auxiliary capacitor 9 is completed, is set to 4 microseconds. The upper limit number of dot lines and the charge complete time are defined based on results of experiments or the like. In FIG. 11, it is assumed that a sufficient time elapses before a dot line d11 and the charging of the power source auxiliary capacitor 9 is completed.

The expansion collective printing can be successively performed until 2 dots, and hence the expansion collective printing is performed in the dot line d11 and a dot line d12. A storage time of 4 microseconds has elapsed before the printing of a dot line d13, and hence the expansion collective printing can be performed. The expansion collective printing is therefore performed in the dot line d13 and a dot line d14. The upper limit of the expansion collective printing is 2 dots, and hence the divisional printing is performed in a third dot line d15 and the subsequent dot lines.

Figure 12:
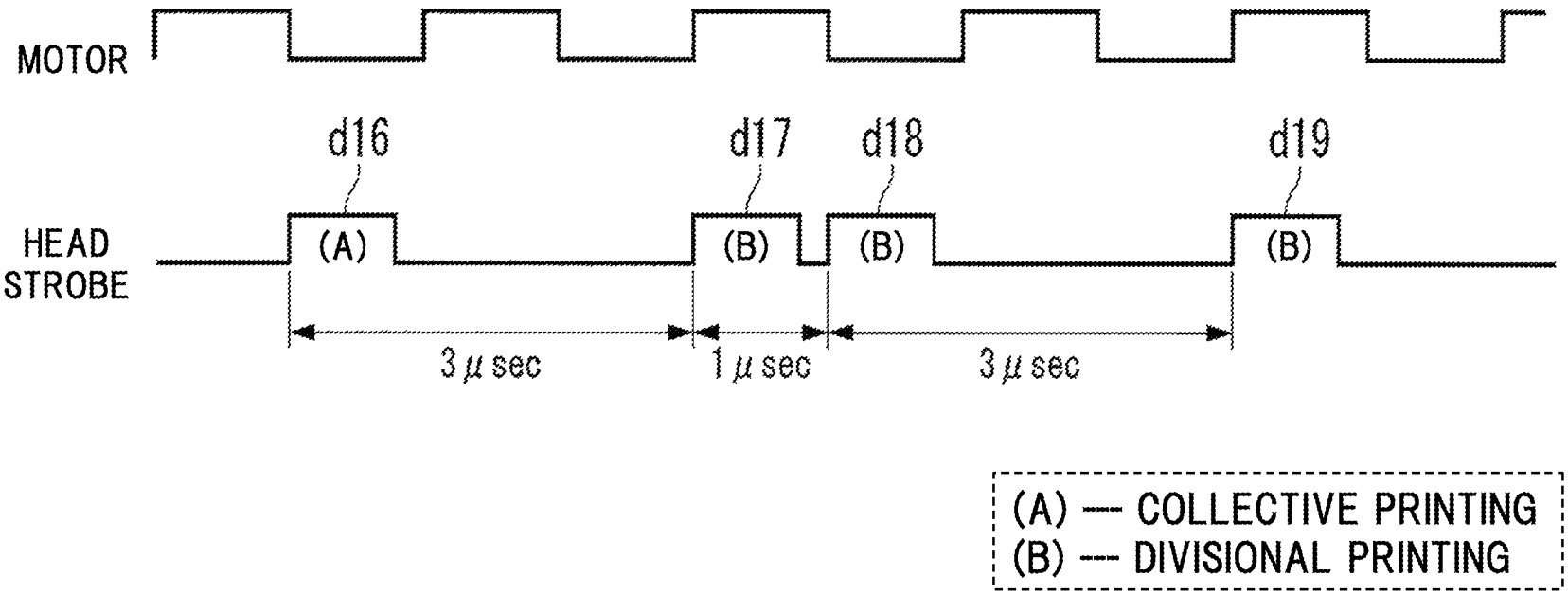
FIG. 12 is a timing chart for illustrating another example of the head drive control using time measurement in the second embodiment.

FIG. 12 is a timing chart for illustrating another example of the head drive control using time measurement in the second embodiment. With reference to FIG. 12, description is given of how the printing control unit 43 of FIG. 10 controls drive of the thermal head 11. In a dot line d16, the expansion collective printing is performed. A storage time of 4 microseconds has not been elapsed before the printing of a dot line d17, and hence the expansion collective printing cannot be performed. The divisional printing is therefore performed in the dot line d17. In a dot line d18, because the divisional printing is performed in the dot line d17, the divisional printing of the remaining printing data in the same line is performed. In a dot line d19, a storage time of 4 microseconds has not been elapsed before the printing, and hence the expansion collective printing cannot be performed. The divisional printing is therefore performed in the dot line d19.

Figure 13:
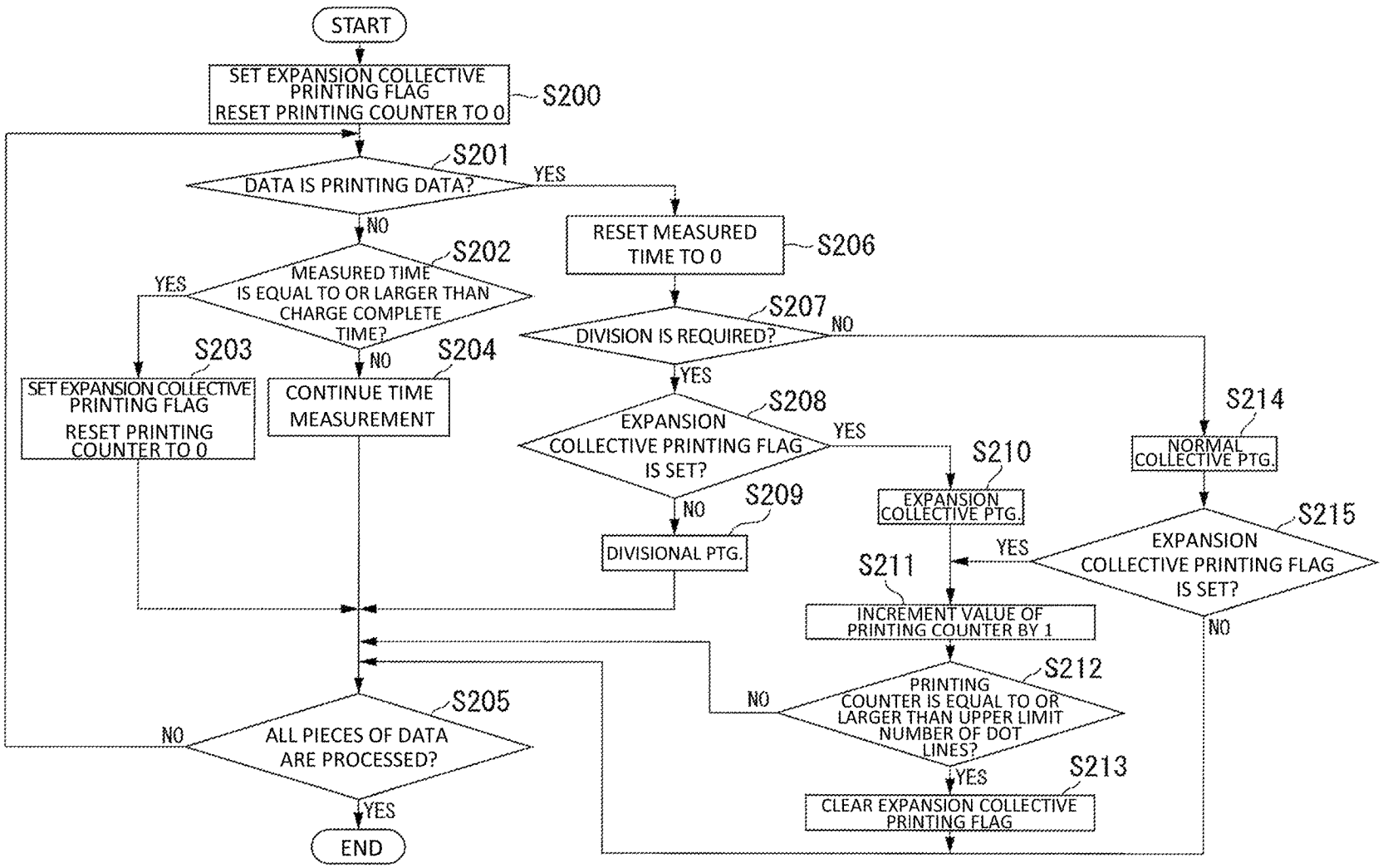
FIG. 13 is a flow chart for illustrating an example of processing in printing control using time measurement in the second embodiment.

FIG. 13 is a flow chart for illustrating an example of processing in printing control using time measurement in the second embodiment. The processing illustrated in the flow chart is executed when the printer TP1*a* receives data from the host 2. It is assumed that the power source auxiliary capacitor 9 is in the fully-charged state when the processing is started. Processing steps of Step S200, Step S201, Step S203, Step S205, Step S207, Step S208, Step S209, Step S210, Step S211, Step S212, Step S213, Step S214, and Step S215 are similar to the processing steps of Step S100, Step S101, Step S103, Step S105, Step S107, Step S108, Step S109, Step S110, Step S111, Step S112, Step S113, Step S114, and Step S115 of FIG. 9, respectively, and hence description thereof is omitted.

(Step S202) The printing data generation unit 41*a* acquires the measured time from the time measurement unit 42*a*. The printing data generation unit 41*a* determines whether or not the measured time is equal to or larger than the charge complete time based on the acquired measured time. The charge complete time is, for example, 4 microseconds. When the printing data generation unit 41*a* determines that the measured time is equal to or larger than the charge complete time (YES), the printing data generation unit 41*a* executes the processing of Step S203. On the other hand, when the printing data generation unit 41*a* determines that the measured time is not equal to or larger than the measured time (NO), the printing data generation unit 41*a* executes the processing of Step S204.

(Step S204) The time measurement unit 42*a* continues the time measurement. After that, the printing data generation unit 41*a* executes the processing of Step S205.

(Step S206) The printing data generation unit 41*a* outputs, to the time measurement unit 42*a*, a measured time reset signal indicating a command to reset the measured time to 0. When the measured time reset signal is input to the time measurement unit 42*a*, the time measurement unit 42*a* resets the measured time to 0. After that, the printing data generation unit 41*a* executes the processing of Step S207.

As described above, the printer TP1*a* according to the second embodiment includes the time measurement unit 42*a*. The control circuit (printing data generation unit 41) is controlled to determine that the predetermined amount of power is stored in the capacitor (power source auxiliary capacitor 9) when the predetermined storage time has elapsed after the capacitor (power source auxiliary capacitor 9) supplies power to the thermal head 11. With this configuration, the printer TP1*a* can determine the state of charge of the capacitor based on only the measured time, and hence the printer TP1*a* can control the heat generators in accordance with the amount of power stored in the capacitor.

A part of the printer TP1 and the printer TP1*a* according to the above-mentioned first and second embodiments, for example, the control units 4 and 4*a*, may be implemented by a computer. In this case, a program for implementing the control functions thereof may be recorded in a computer-readable recording medium to be read and executed by a computer system. The "computer system" here is a computer system that is built in the printer TP1 and the printer TP1*a*, and includes an OS and hardware such as peripheral equipment. The "computer-readable recording medium" is a portable medium such as a flexible disk, a magneto-optical disk, a ROM, a CD-ROM, or a storage apparatus built in the computer system, for example, a hard disk. Examples of the "computer-readable recording medium" may also include a medium that holds the program dynamically for a short length of time, such as the Internet or a similar network or a phone line or a similar communication line through which the program is transmitted, and a medium that holds the program for a predetermined length of time, such as a volatile memory inside the computer system that serves as a server or a client when the program is transmitted over a network or a communication line. The program may be one that implements some of the functions described above, or may implement the described functions in combination with a program that is already recorded in the computer system. Alternatively, a part of or all of the printer TP1 and the printer TP1*a* in the first and second embodiments described above may be implemented in the form of an integrated circuit, for example, a large-scale integration (LSI) circuit. The function blocks of the printer TP1 and the printer TP1*a* may be made into processors individually, or some or all of the function blocks may be integrated into a processor. The method of integration is not limited to LSI, and the integration may be accomplished with the use of a dedicated circuit or a general-purpose processor. If a future advance of semiconductor technology produces integration technology that can substitute for LSI, an integrated circuit according to this integration technology may be used.

While detailed description has been given above on the embodiments of the present invention, the concrete configuration of the present invention is not limited to the ones described above, and various design modifications and the like can be made without departing from the gist of the present invention.

What is claimed is:

1. A head drive device, comprising:

a thermal head, which is configured to cause one of a first group of heat generators and a second group of heat generators having a smaller number of heat generators than the first group of the heat generators, to generate heat;

a capacitor configured to store power;

a control circuit programmed, based on printing data, to select whether to perform printing with use of the first group of the heat generators or to perform printing with use of the second group of the heat generators; and a drive circuit programmed to:

supply power of a power source and the power stored in the capacitor to the thermal head when the first group of the heat generators are used; and supply the power of the power source to the thermal head when the second group of the heat generators are used, the control circuit being programmed to:

determine whether a predetermined amount of power is stored in the capacitor;

allow printing with use of at least a part of the first group of the heat generators when the control circuit determines that the predetermined amount of power is stored in the capacitor; and allow printing with use of at least a part of the second group of the heat generators when the control circuit determines that the predetermined amount of power is not stored in the capacitor.

2. A head drive device according to claim 1, wherein the control circuit is programmed to:

calculate a number of heat generators to be caused to generate heat based on the printing data;

allow printing with use of at least a part of the second group of the heat generators when the calculated number of heat generators is equal to or smaller than a threshold value; and allow printing with use of at least a part of the first group of the heat generators when the calculated number of heat generators is larger than the threshold value and the control circuit determines that the predetermined amount of power is stored in the capacitor, and allow printing with use of at least a part of the second group of the heat generators when the control circuit determines that the predetermined amount of power is not stored in the capacitor.

3. A head drive device according to claim 1, wherein the thermal head is configured to cause one of the first group of the heat generators and the second group of the heat generators, to generate heat, the second group of the heat generators corresponding to at least one block obtained when the first group of the heat generators are divided into a plurality of blocks, and the control circuit is programmed to:

calculate a number of heat generators to be caused to generate heat in one row of the thermal head;

allow printing with use of at least a part of the first group of the heat generators when the calculated number of heat generators is equal to or smaller than an upper limit value of the number of heat generators that is able to be printed by the power of the power source; and allow printing with use of at least a part of the first group of the heat generators when the calculated number of heat generators is larger than the upper limit value of the number of heat generators that is able to be printed by the power of the power source and the control circuit determines that the predetermined amount of power is stored in the capacitor, and allow printing with use of at least a part of the second group of the heat generators when the control circuit determines that the predetermined amount of power is not stored in the capacitor.

4. A head drive device according to claim 1, wherein the control circuit is programmed to determine that the predetermined amount of power is stored in the capacitor when a printing medium is conveyed by an amount that is equal to or larger than a predetermined movement amount after the capacitor supplies power to the thermal head.

5. A head drive device according to claim 4, further comprising a counting unit programmed to count a number of lines of printing, wherein the control circuit is programmed to determine that the predetermined amount of power is stored in the capacitor when the printing medium is conveyed by an amount that is equal to or larger than a predetermined number of lines after the capacitor supplies power to the thermal head.

6. A thermal printer, comprising:

a conveyance mechanism configured to convey a printing medium; and the head drive device of claim 1, wherein the heat generators are arranged in one row that is orthogonal to a conveyance direction of the printing medium, and the drive circuit is programmed to control a speed at which the conveyance mechanism conveys the printing medium.

7. A method of controlling a head drive device, the head drive device including a thermal head, which is configured to cause one of a first group of heat generators and a second group of heat generators a smaller number of heat generators than the first group of the heat generators, to generate heat; and a capacitor configured to store power, the method comprising:

selecting based on printing data whether to perform printing with use of the first group of the heat generators or to perform printing with use of the second group of the heat generators;

supplying power of a power source and the power stored in the capacitor to the thermal head when the first group of the heat generators are used, and supplying the power of the power source to the thermal head when the second group of the heat generators are used;

determining whether a predetermined amount of power is stored in the capacitor;

allowing printing with use of at least a part of the first group of the heat generators when the predetermined amount of power is determined to be stored in the capacitor; and allowing printing with use of at least a part of the second group of the heat generators when the predetermined amount of power is not determined to be stored in the capacitor.

8. A method of controlling a head drive device according to claim 7, further comprising:

calculating a number of heat generators to be caused to generate heat based on the printing data;

allowing printing with use of at least a part of the second group of the heat generators when the calculated number of heat generators is equal to or smaller than a threshold value; and allowing printing with use of at least a part of the first group of the heat generators when the calculated number of heat generators is larger than the threshold value and the predetermined amount of power is determined to be stored in the capacitor, and allowing printing with use of at least a part of the second group of the heat generators when the predetermined amount of power is not determined to be stored in the capacitor.

9. A method of controlling a head drive device according to claim 7, wherein the thermal head is configured to cause one of the first group of the heat generators and the second group of the heat generators, to generate heat, the second group of the heat generators corresponding to at least one block obtained when the first group of the heat generators are divided into a plurality of blocks, and the method further comprising:

calculating a number of heat generators to be caused to generate heat in one row of the thermal head;

allowing printing with use of at least a part of the first group of the heat generators when the calculated number of heat generators is equal to or smaller than an upper limit value of the number of heat generators that is able to be printed by the power of the power source; and allowing printing with use of at least a part of the first group of the heat generators when the calculated number of heat generators is larger than the upper limit value of the number of heat generators that is able to be printed by the power of the power source and the predetermined amount of power is determined to be stored in the capacitor, and allowing printing with use of at least a part of the second group of the heat generators when the predetermined amount of power is not determined to be stored in the capacitor.

10. A method of controlling a head drive device according to claim 7, further comprising determining that the predetermined amount of power is stored in the capacitor when a printing medium is conveyed by an amount that is equal to or larger than a predetermined movement amount after the capacitor supplies power to the thermal head.

11. A method of controlling a head drive device according to claim 10, the head drive device further including a counting unit programmed to count a number of lines of printing, the method further comprising determining that the predetermined amount of power is stored in the capacitor when the printing medium is conveyed by an amount that is equal to or larger than a predetermined number of lines after the capacitor supplies power to the thermal head.

* * * * *